US010005635B2

(12) United States Patent
Martinez et al.

(10) Patent No.: US 10,005,635 B2
(45) Date of Patent: Jun. 26, 2018

(54) WINDER FOR AN ENDLESS MATERIAL WEB

(71) Applicants: Swiss Winding Inventing AG, Pfäffikon (CH); Windmöller & Hölscher KG, Lengerich (DE)

(72) Inventors: Carlos Martinez, Altendorf (CH); Rolf Kammann, Westerkappeln (DE); Carl Jones, Solihull (GB)

(73) Assignees: Swiss Winding Inventing AG, Pfäffikon (CH); Windmöller & Hölscher KG, Lengerich (DE)

( * ) Notice: Subject to any disclaimer, the term of this patent is extended or adjusted under 35 U.S.C. 154(b) by 237 days.

(21) Appl. No.: 14/359,522

(22) PCT Filed: Nov. 20, 2012

(86) PCT No.: PCT/CH2012/000259
§ 371 (c)(1),
(2) Date: May 20, 2014

(87) PCT Pub. No.: WO2013/075258
PCT Pub. Date: May 30, 2013

(65) Prior Publication Data

US 2014/0299705 A1 Oct. 9, 2014

(30) Foreign Application Priority Data

Nov. 21, 2011 (CH) ..... 1860/11

(51) Int. Cl.
*B65H 18/08* (2006.01)
*B65H 23/195* (2006.01)

(52) U.S. Cl.
CPC ..... *B65H 18/08* (2013.01); *B65H 23/195* (2013.01); *B65H 2511/21* (2013.01); *B65H 2511/22* (2013.01)

(58) Field of Classification Search
CPC .. B65H 18/20; B65H 18/26; B65H 2511/216; B65H 2701/177; B65H 2701/1846;
(Continued)

(56) References Cited

U.S. PATENT DOCUMENTS 4,199,117 A * 4/1980 Muller ..... B21C 47/003 226/195
4,274,604 A * 6/1981 Vetterli ..... B65H 54/28 242/154

(Continued)

FOREIGN PATENT DOCUMENTS

DE 2423227 A1 11/1975
DE 3600517 A1 7/1987

(Continued)

OTHER PUBLICATIONS

Haaken, Willy, "International Search Report," prepared for PCT/CH2012/000259, dated Feb. 12, 2013, 4 pages.

*Primary Examiner* — William A. Rivera
(74) *Attorney, Agent, or Firm* — Winstead PC

(57) ABSTRACT

The present invention relates to a method and a device for producing a roll (18) made of a material web (5) of flexible material which is guided via a contact roller (19) of a winder and is wound in the said winder to form a roll (18), wherein the contact roller (19) maintains contact with the roll (18) during winding and the wrap angle (α) of the material web (5) passing over the contact roller (19), as the former is progressively wound, is maintained throughout at a variable reference value predetermined for each winding. In this way the wrap angle (α) for the winding can be adapted to the respective composition of the material web (5), which improves the quality of the winding.

20 Claims, 7 Drawing Sheets

Figure 1A:
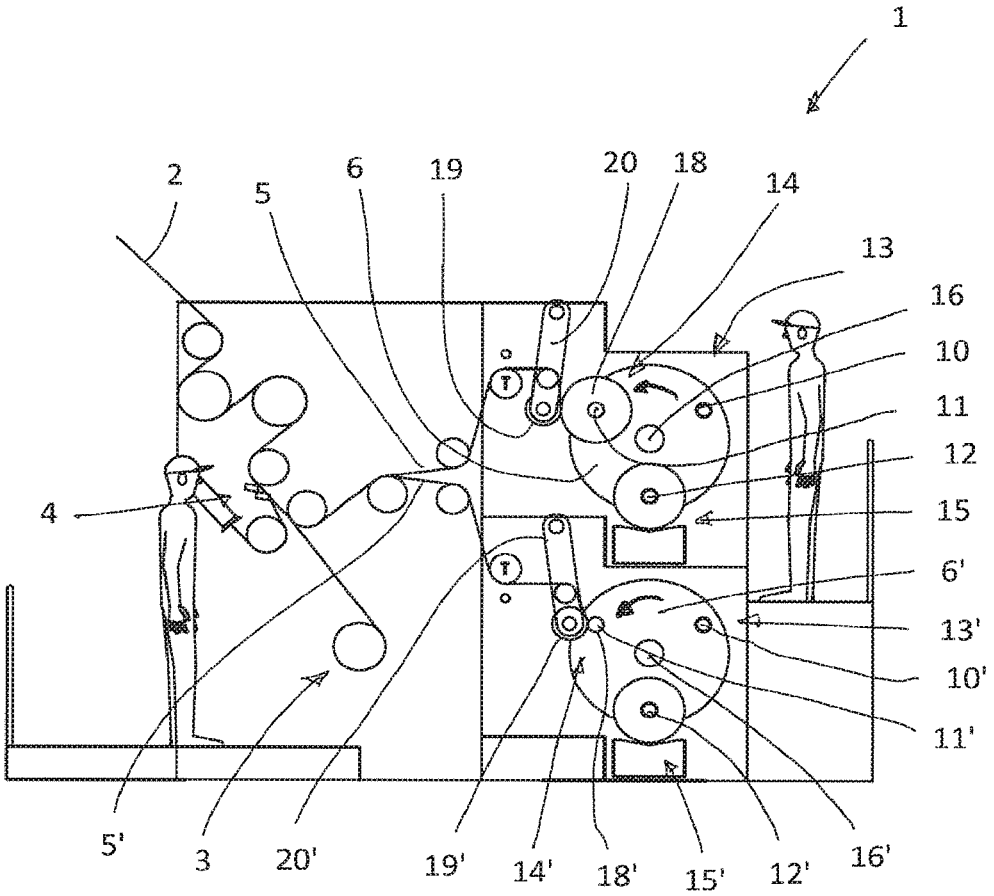
Fig 1a Prior Art

(58) Field of Classification Search
CPC ..... B65H 2301/41485; B65H 2301/414866; B65H 18/08; B65H 23/195; B65H 2511/21; B65H 2511/22; B65H 2220/02
USPC ..... 242/541, 542, 542.2
See application file for complete search history.

(56) References Cited

U.S. PATENT DOCUMENTS 4,463,586 A * 8/1984 Griffin ..... B21B 38/02 242/534
4,465,243 A * 8/1984 Welp ..... B65H 18/20 242/541.4
4,524,919 A * 6/1985 Wehrmann ..... B65H 18/16 242/533.5
4,598,877 A * 7/1986 Oinonen ..... B65H 18/20 242/541.5
5,035,373 A * 7/1991 Perrigo ..... B65H 18/26 242/413.3
5,377,931 A * 1/1995 Dorfel ..... B65H 18/26 242/530
5,655,730 A 8/1997 Beisswanger et al.
6,089,496 A * 7/2000 Dorfel ..... B65H 18/00 242/413.1
6,427,939 B1 * 8/2002 Miyata ..... B21C 47/003 242/534.2
6,626,394 B1 * 9/2003 Kojo ..... B65H 19/2207 242/540
7,455,259 B2 * 11/2008 Koutonen ..... B65H 18/20 242/541
8,991,737 B2 * 3/2015 Leppa ..... B65H 26/025 242/420.5

FOREIGN PATENT DOCUMENTS

DE 102009005355 A1 7/2009
GB 1017687 A 1/1966
JP H09315632 A 12/1997
WO WO-03106313 A1 12/2003

* cited by examiner

WINDER FOR AN ENDLESS MATERIAL WEB

The present invention concerns a method for the manufacture of a roll of a material web of flexible material in accordance with the preamble of Claim 1, and a winder for the execution of this method in accordance with the preamble of Claim 6.

Flexible, continuous material webs are predominantly processed on production lines in which an extruder generates a continuous plastic film, which is to be wound continuously and without interruption onto winding cores.

In particular, plastic films are manufactured in an extraordinary variety of compositions and correspondingly with a very wide range of properties; the latter also influence the behaviour of the roll and accordingly must be taken into account during the winding process. The speed of the production line and the number of rolls to be manufactured in a production run are also parameters that must be taken into account to ensure production of sufficient quality with, at the same time acceptable costs.

Typical processing speeds range from 2 to 1000 m/min, while the complete rolls can possess a diameter of between 50 and 2000 mm, and a width of between 10 and 6000 mm. Thicknesses can range from a few μm up to the millimeter range. As an example films can be cited with a thickness of 8 μm to 25 μm, preferably 15 μm to 25 μm, which are wound with a speed of 100 m/min and a width of ca. 300 mm to 770 mm onto a winding shaft with a utilisation factor of 4 (i.e. four winding sleeves are attached to one winding shaft and thus four rolls are wound parallel to one another).

The composition of plastic films, in particular, from polyolefins (such as PE polyethylene or PP polypropylene) ranges from the mono-extruded film, consisting of a single layer, through to co-extruded films with three, five or more layers, wherein adhesives of a very wide variety can be provided, for example, in the layers, such that a very wide variety of multi-layer films are created.

Today some forty to fifty compositions are of known art in the sector of silage films and stretch films; in each case these possess the various properties required for the application. In northern countries, for example, in agriculture it is required that the grass rolls wound in film, which can weigh up to 500 kg, and are to remain in the fields, retain their shape even when snow covered; this presupposes a high strength film. In other countries the film should be black. Alternatively a film of a certain colour can be preferred, e.g. green for visual reasons.

When a grass roll is being wound the adhesive contained between the plastic layers of the film ensures that the individual windings around the grass roll adhere to one another such that the wound roll possesses stability. As the grass roll is being formed, a typical rasping noise occurs as the film is unwound from the roll, which is louder or quieter depending upon the adhesive. Certain agricultural operations demand films that are quiet to release, a requirement that has a corresponding influence on the whole composition of the film.

The same is true in the field of, for example, stretch films, which are used for the packaging of goods stacked on pallets as protective films (for example in electronics) or as films for foodstuffs. Thus the foodstuff film used domestically, for example, adheres to the edge of the plate as a result of the adhesive extruded at the point at which the film wraps around the edge of the plate, by virtue of the local pressure thereby generated. Here too the compositions are as numerous as the possible uses for the films and are matched to the application in question.

Production fluctuates as required between the manufacture of only a few wound rolls of the same type for special applications through to mass production of wound rolls of the same type.

By virtue of the different compositions the films themselves possess different properties, which in turn must be taken into account during the winding of fault-free film rolls; this sets particular requirements on the winder concerning the parameters such as web tension, winding pressure, speed, and film thickness and elasticity of the film.

Fault-free winding that takes account of the above-cited parameters is also important because in the case of some compositions the finished wound film (as a rule the winder is directly downstream of the extruder manufacturing the film) is still active, because the various plastic layers are still stabilising, and the air or other introduced substances included between the layers, often adhesives, are altering and are also migrating through the layers. In other words the fact is that the manufacturing process for the films is not yet complete after the winding process. As a result of a winding process that is not absolutely flawless it can therefore happen at that a roll still alters in a negative manner subsequently during storage and becomes unusable.

FIG. 1*a* shows an example of a winder 1 in accordance with the prior art, in a side view that illustrates the path of the continuous material web, here a plastic film 2, through the winder 1. A separate winding unit 3 for scrap film is followed by a cutting unit 4, which separates the continuous film 2 lengthwise, so that two separate film webs or films, 5 and 5', are created, wherein each of the films 5 and 5' is guided into a winding process in an assigned revolver unit 6, 6'. The revolver units 6, 6' are fundamentally built in the same manner, and in the form of embodiment illustrated each possesses three winding shafts, namely a first winding shaft 10, 10', a second winding shaft 11, 11' and a third winding shaft 12, 12'.

The winding shafts 10, 10' to 12, 12' are located in different workstations, namely a loading station 13, 13', a winding station 14, 14' and a removal station 15, 15'.

The revolver units 6, 6' are designed such that they can be rotated about their longitudinal axes 16, 16' in a stepwise manner in the counter-clockwise sense in accordance with the arrows as drawn by means of a drive, which has been omitted from the figure so as to ease the burden of detail in the latter, such that each of the winding shafts 10, 10' to 12, 12' in a further rotational step is brought from its previous workstation into its next workstation. The revolver units 6, 6' thus form an entity for the mounting of the rolls to be wound 18, 18' in the manner as follows:

in a cycle each of the winding shafts 10, 10' to 12, 12' passes the loading station 13, 13', where it is loaded with fresh winding sleeves; by means of a further rotational step of the revolver units 6, 6' it moves into the winding station 14, 14', where the winding cores 17 are wound with the film 2 to form a roll 18, and from there it moves into the removal station 15, 15', where the roll 18 is removed from the revolver unit 6, 6'.

The figure shows a complete roll 18 in the winding station 14 and a roll 18' in the early stages of winding in the winding station 14'.

A contact roller 19, 19' makes contact with the roll 18, 18' and ensures that the appropriate pressure is applied in the winding station 14, 14' for the composition of the film in question. In the proven (but not the only) embodiment illustrated in accordance with the prior art the contact roller 19, 19' is suspended on swing arms 20, 20'; this enables the contact roller 19, 19' to move in accordance with the progression of the winding process for the stationary wound roll 18, 18'.

In what follows the invention is described in terms of a winder designed in accordance with FIG. 1*a*. However, the invention is not limited to such winders (here: those with revolver units, wherein the contact roller is mounted on swing arms). The invention can be applied to large or small winders, which have a utilisation factor of one, or a multiple utilisation factor.

Figure 1B:
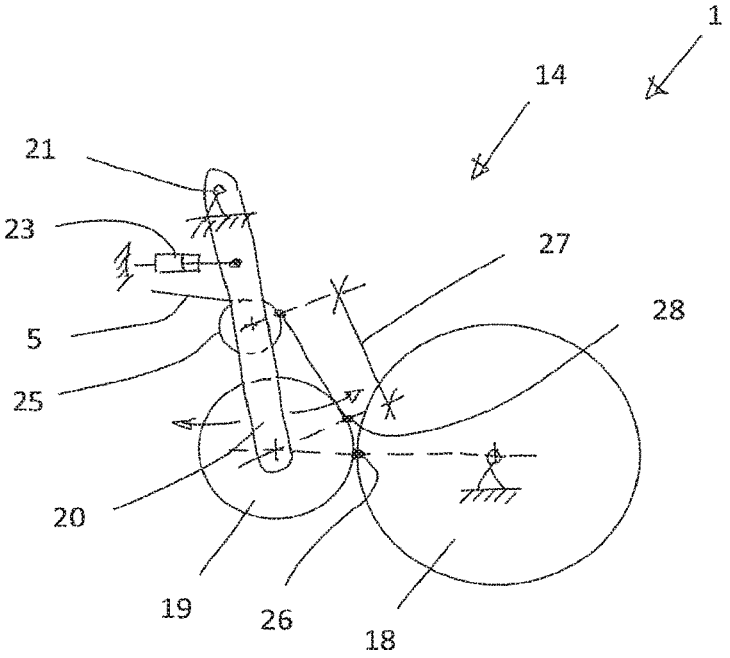
Fig 1b Prior Art

FIG. 1*b* shows a detail of the winder 1, namely the winding station 14 and the contact roller 19 including its mounting, once again as seen from the side.

The figure illustrates that the contact roller 19 is suspended on two swing arms 20 engaging at either side, and can thus be pivoted about a pivot axis 21. By virtue of the view from the side, only one swing arm 20 is visible in the figure since this covers the other swing arm (which engages at the other end of the contact roller 19). The swing arms 20 enable the contact roller 19 to undertake a movement in the direction of the arrows as drawn, so that it can always migrate with the growing diameter of the roll 18 (in the present arrangement the winding core on which the film 5 is wound is fixed in its mounting). A pressure application unit, here a piston arrangement 23, provides the pressure that is applied by the contact roller 19 onto the roll 18 in accordance with the composition.

When the winder 1 is in operation the film 5 runs over an ancillary roller 25 and from the latter onto the contact roller 19, where it is pressed onto the roll 18 along the contact line 26 and wound onto the latter. This ensures that the film 5 only runs freely between the ancillary roller 25 and the contact roller 19 over a short distance 27, which is advantageous: In this manner the film 5, which sometimes is running very fast indeed (see above for the feed rates), has already stabilised before it arrives at the location of the contact line 28 on the contact roller 19, which aids a fault-free winding process.

As already stated FIGS. 1*a* and 1*b* show an arrangement of the prior art that is known to the person skilled in the art.

It is now the object of the present invention to improve further a winder for a continuous material web, so as in particular to be able to wind optimally even those compositions that are difficult to wind.

To achieve this object the inventive method has the identifying features of Claim 1 and the inventive winder has the identifying features of Claim 6.

In that the inventive method and the inventive device provide for maintenance of the wrap angle of the material web running over the contact roller at a variable design value or set value that can be predetermined as the winding process proceeds, any warpage of the wound material web, i.e. film, at the location of the contact line 26 between the contact roller 19 and the roll 18 can be suppressed or reduced. Even in the case of moderately sensitive compositions such warpage leads to an optically visible pattern in the wound film, and in an unfavourable case to the formation of creases. Both signify scrap production.

Figure 2A:
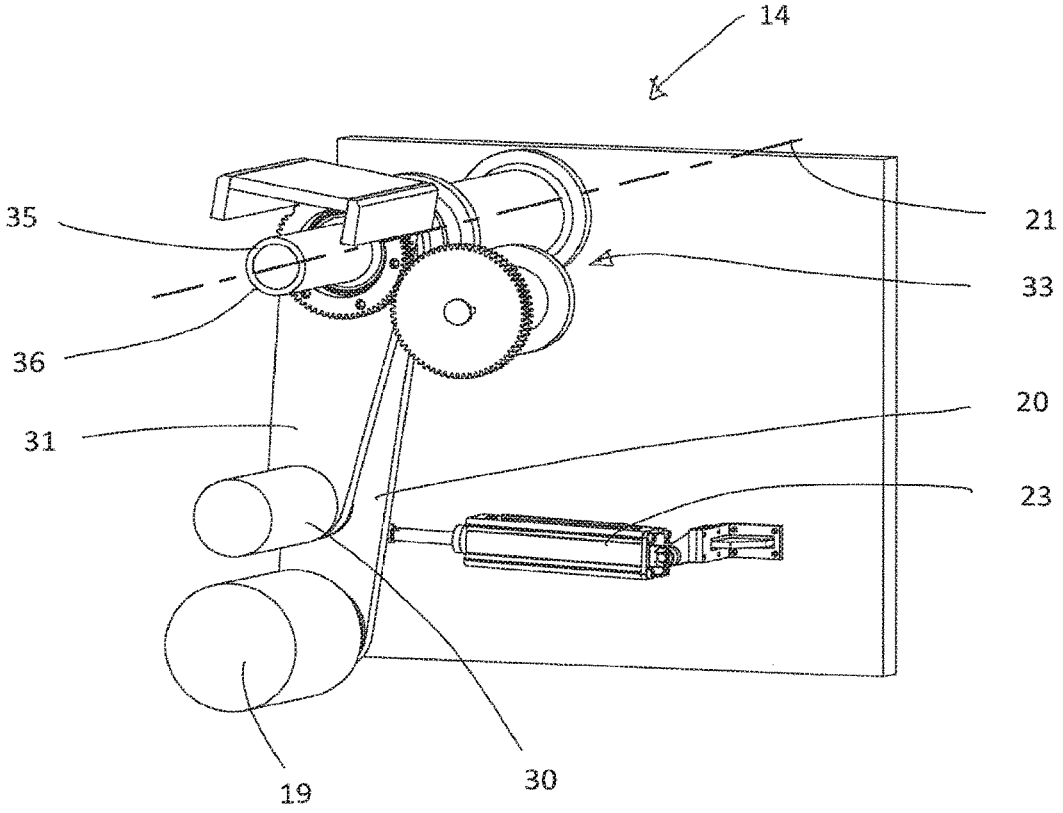
Figure 2B:
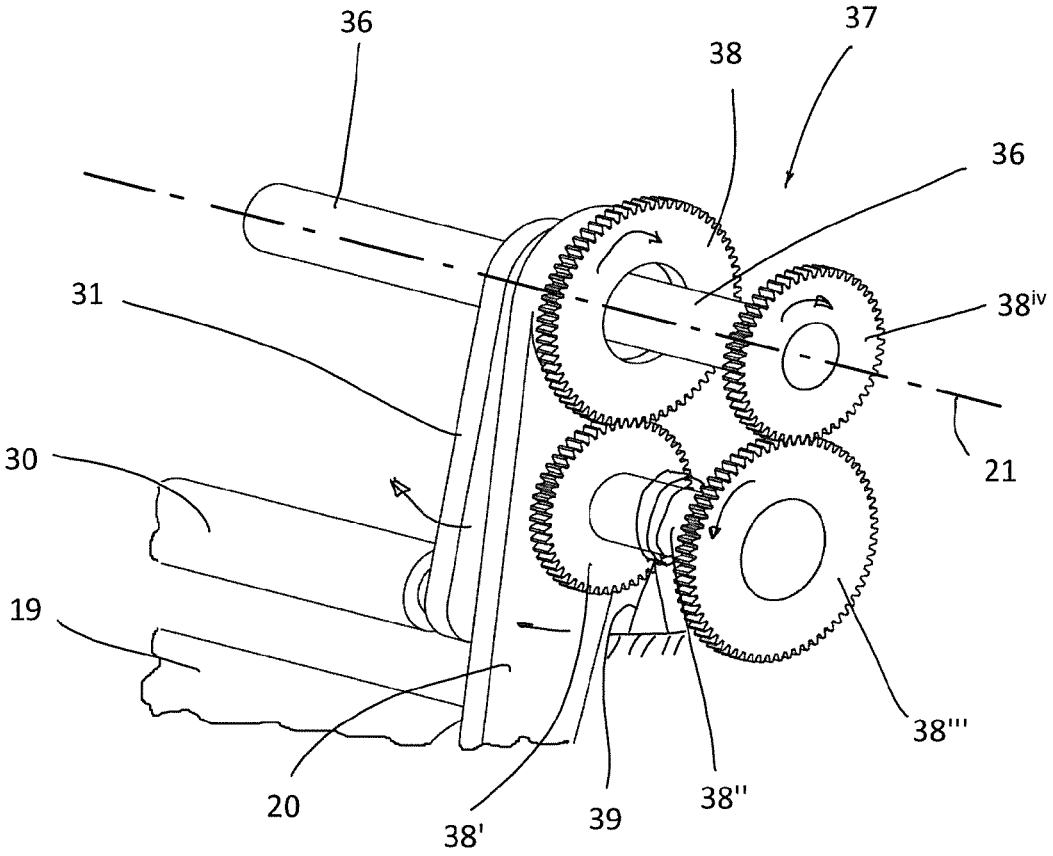
Figure 3:
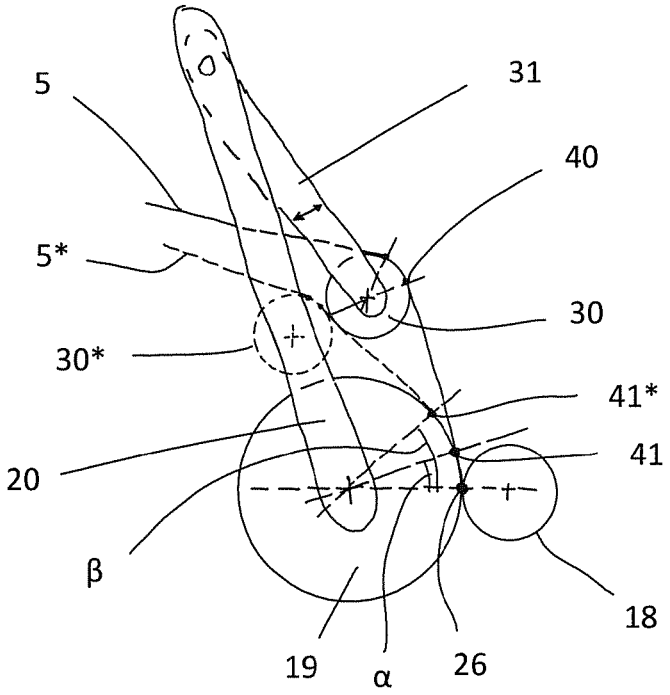
Figures 4A, 4B, 4C, 4D, 4E:
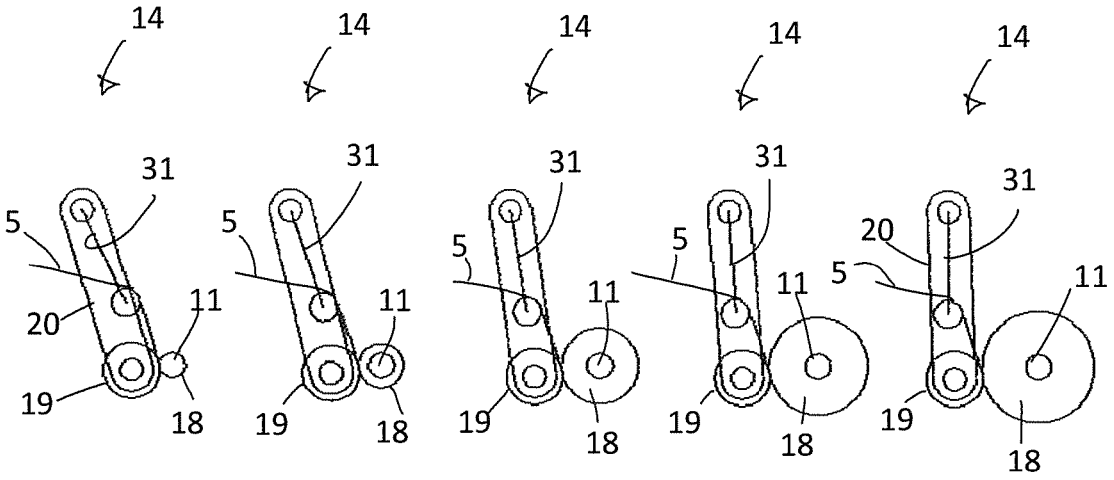
Figure 5A:
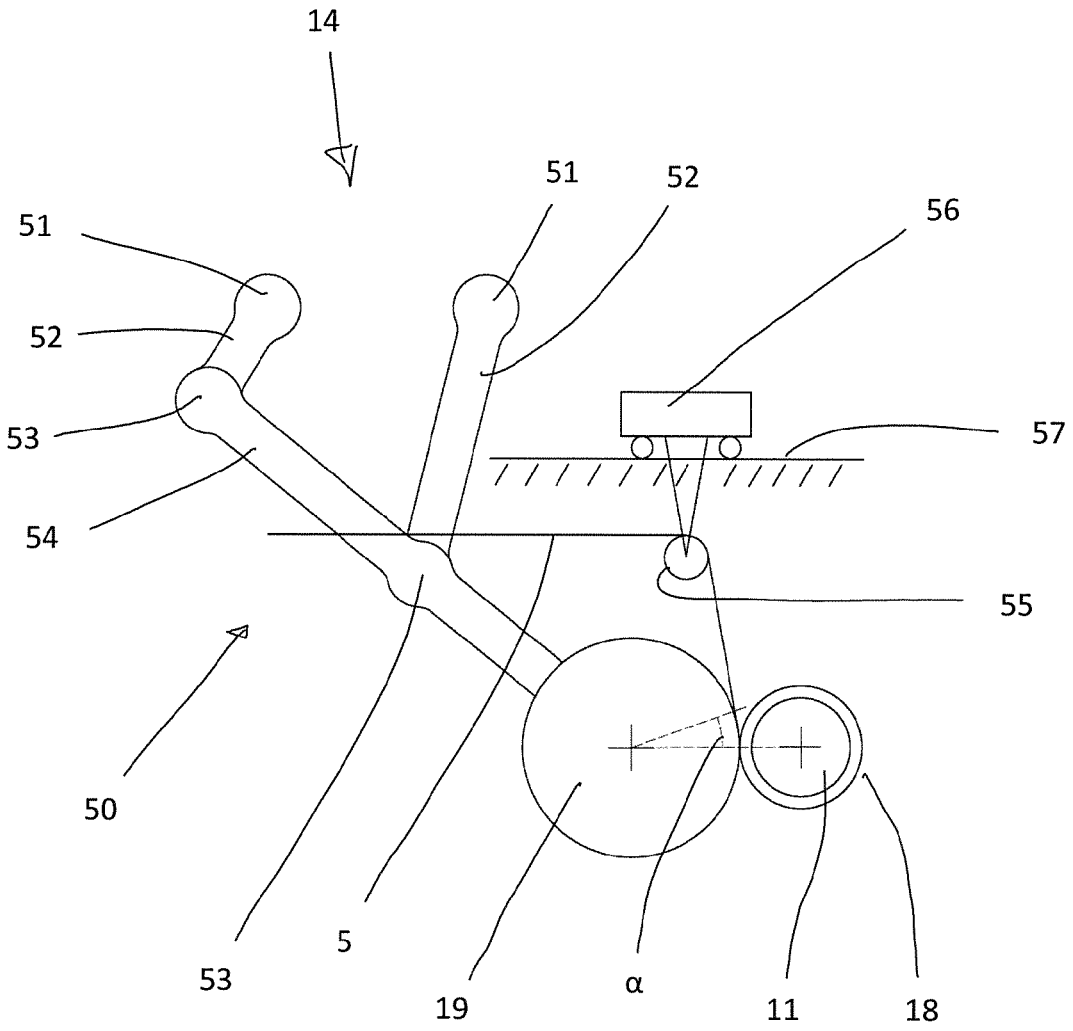
Figure 5B:
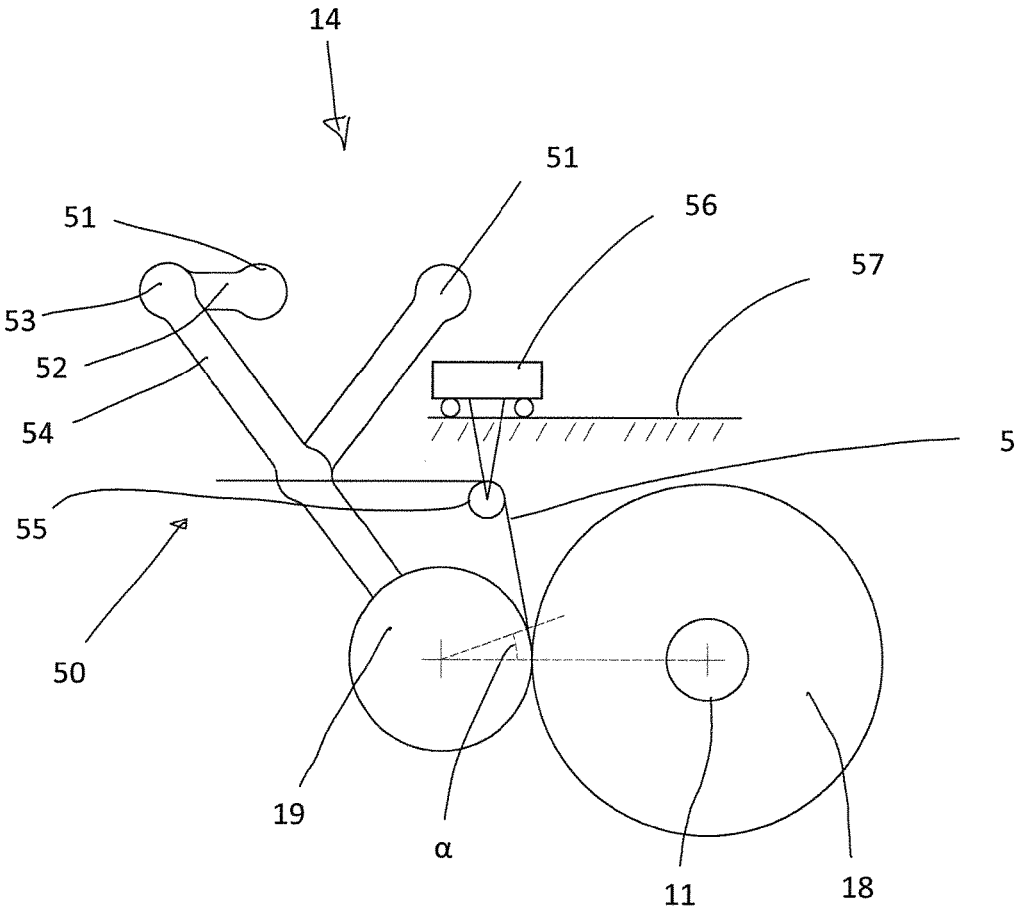
Figure 6:
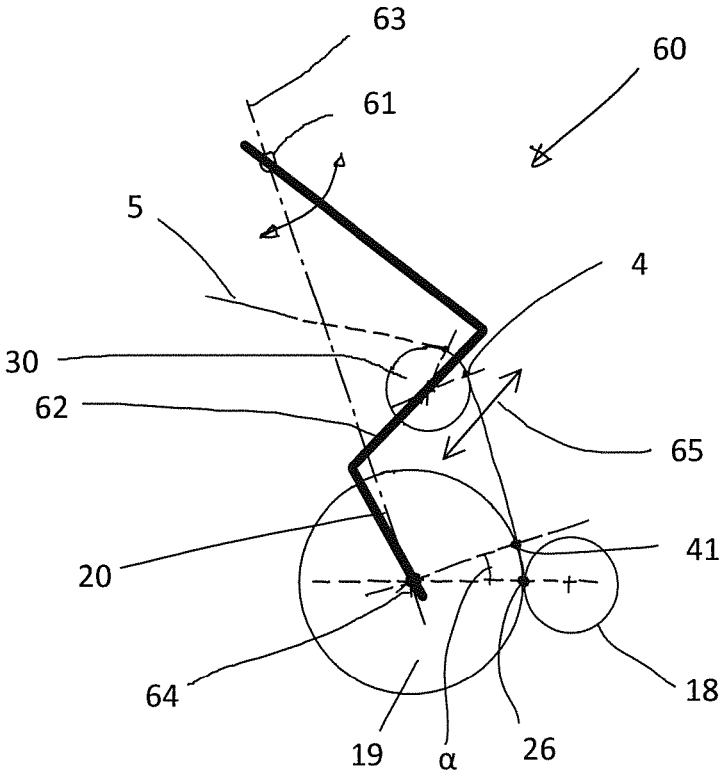

In what follows the invention is explained in more detail. In the figures:

FIG. 1*a* shows schematically a winder in accordance with the prior art, as seen from the side, FIG. 1*b* shows a detail from FIG. 1*a* with the contact roller, FIG. 2 shows a three-dimensional view onto a part of the winding station, wherein the arrangement of contact roller and ancillary roller is illustrated in accordance with the present invention, FIG. 3 shows schematically the arrangement of FIG. 2, wherein at the same time the variation from the prior art is illustrated, FIGS. 4*a* to 4*e* show schematically a sequence that illustrates the inventive winding process, FIGS. 5*a* and 5*b* show schematically a further form of embodiment in accordance with the present invention, in which the ancillary roller is mounted on a rail, and FIG. 6 shows schematically a further form of embodiment of the present invention.

FIG. 2*a* shows a three-dimensional view of the inner face of the one swing arm 20 in a preferred form of embodiment of the present invention, in which the contact roller 19 is suspended on swing arms 20, as described with the aid of FIG. 1*b*. The piston arrangement 23 for purposes of pivoting the swing arms 20 about the pivot axis 21 can be seen. An ancillary roller 30 can also be seen; however, this is not fixed to the swing arms 20, but instead for its part is arranged on further swing arms 31.

In the form of embodiment shown the further swing arms 31 for the ancillary roller 30 are pivoted via a gear train 33, which for its part possesses a drive that is not illustrated so as to ease the burden of detail in the figure. In this manner the pivotal movements of the swing arms 20 and the further swing arms 31 can take place independently of one another, and the movement of the ancillary roller 30 can take place independently of the movement of the contact roller 19.

The swing arms 20, 31 pivot about the pivot axis 21 that is common to them both. The two swing arms 20 are preferably connected with one another via a tube 35, and the two further swing arms 31 are preferably connected with one another via a tube 36, which ensures their synchronous movement. In the form of embodiment shown the tubes 35, 36 are arranged coaxially with respect to one another, and also with respect to the pivot axis 21. So as to ease the burden of detail in the figure a machinery controller is also omitted; this controls the drives for the swing arms 20 for the contact roller 19 and the further swing arms 31 for the ancillary roller 30.

FIG. 2*b* shows a form of embodiment of the present invention that has been modified with respect to FIG. 2*a*. The figure illustrates a three-dimensional view onto the outer face of the one swing arm 20 illustrated in FIG. 2*a*, here with a gear train 37, which connects the swing arm 20 and the further swing arm 31 with one another. The two swing arms 20, 31 possess the common pivot axis 21, wherein in the figure the tube 36 is illustrated, which connects the visible further swing arm 31 with the second further swing arm; the latter has been omitted so as to ease the burden of detail in the figure and is therefore not visible. The tube 35 as per FIG. 2*a*, which connects the swing arm 20 with the opposite swing arm (not visible in the figure), would cover the tube 36, and is therefore also omitted so as to ease the burden of detail in the figure.

The contact roller 19 is mounted between the swing arm 20 and the swing arm that is not visible; the ancillary roller is mounted between the further swing arm 30 and the further swing arm that is not visible.

A gear 38 is fixed on the swing arm 31; when in operation this gear rotates with the swing arm 31 about the pivot axis 21 (here the swing arm 31 is similarly driven by a cylinder arrangement, see the cylinder arrangement 23 in FIG. 2*a*). By this means the gear 38', which is in engagement with the gear 38, also rotates; via a shaft 38" this drives the gear 38''', which for its part is in engagement with the gear 38$^{iv}$. The gear 38" is mounted in a suitable form on the frame of the winder, see the mounting 39 drawn schematically in the figure; thus it does not follow the pivotal movement of the swing arm 31.

Finally the gear 38$^{iv}$ is connected with the tube, so that the further swing arm 31 pivots in accordance with the rotation of the gear 38$^{iv}$.

It ensues that the swing arm 20 and the further swing arm 31 are connected with one another, wherein in the event of a pivotal movement of the swing arm 20 (for example, by means of the cylinder arrangement 23 of FIG. 2*a*) the gear train 37 generates a pivotal movement of the further swing arm 31. In this manner, depending upon the transmission ratio of the gear train 37, the ancillary roller, when in operation can in turn be continuously positioned such that the wrap angle α of a film running over the contact roller 19 is constant, or alters in a predetermined manner; on this matter see FIG. 3.

If, for example, the transmission ratio is selected in the range 1:1.5, or more exactly 1:1.51, for a length of the swing arm 20 of 600 mm, a length of the further swing arm 31 of 400 mm, a diameter of the contact roller 19 of 230 mm and a diameter of the ancillary roller of 150 mm, the wrap angle α remains constant.

FIG. 3 shows schematically a comparison between the form of embodiment of the present invention as illustrated in FIG. 3, and an arrangement in accordance with the prior art as per FIG. 1*b*.

In the figure can be seen a roll 18 in the early stages of winding on, which still possesses a small diameter. Accordingly the swing arms 20 are deflected to the right, wherein the contact roller 19 makes contact with the roll 18 along the contact line 26. Also deflected to the right are the inventive further swing arms 31, so that the ancillary roller 30 has moved with them to the right. The film 5 runs onto the ancillary roller 30 and then off the latter once again along the line 40; it runs onto the contact roller along the line 41, wraps around the contact roller 19 as far as the contact line 26; there it runs off the contact roller once again and at the same time onto the roll 18.

The lines 41, 26 determine the wrap angle α of the film 5 on the contact roller 19 in accordance with the inventive arrangement.

In the figure a virtual ancillary roller 30* in accordance with the prior art is illustrated in the form of a dashed line, i.e. it is arranged at a fixed location on the swing arms 20. The path 5* of the film 5* then running conventionally over the ancillary roller 30* is different: a film running on the path 5* runs along the line 41* onto the contact roller 19 and of course runs off the contact roller once again along the line 26.

The lines 41*, 26 determine the wrap angle β of a film running on the path 5* on the contact roller 19, as is the case in an arrangement in accordance with the prior art.

It ensues that the wrap angle α in accordance with the inventive arrangement is smaller than the wrap angle β in accordance with the arrangement known in the prior art.

In accordance with the findings of the applicant, during the process of winding the film 5, air that is carried along as a result of the feed rate of the latter is introduced into the gap ahead of the line 41 (or correspondingly the line 41*) and then penetrates into the wrap around region. In the wrap-around region, particularly at the location of the contact line 26, this air is compressed and as a result is pushed out backwards once again (i.e. against the feed direction of the film 5). In this manner an air cushion develops in the region of the wrap angle, which corresponds to a state of equilibrium between the air that is continuously fed in by the film 5 running through the winder and the air that is then squashed backwards ahead of the contact line 26. At the location of the contact line 26 a higher pressure prevails as a result of the pressure of the contact roller 19.

The air, which in this manner is progressively compressed towards the contact line 26, exerts significant additional forces on the film 5.

These forces can locally warp the film; at the same time the film can warp as a result of local bubbles of compressed air that are formed, through to the formation of small air pockets. Such warpage is then pressed flat along the contact line 26 and forms a pattern or creases.

In other words it is not possible for the film 5 to be wound flat onto the roll; instead it arrives on the roll 18 in a crinkled state.

A reduced wrap angle α now makes it possible for the air that is squashed backwards to escape more easily, so that the quantity of air that reaches as far as the contact region at the location of the contact line 26 between the contact roller 19 and the roll 18 is reduced, as a result of which the risk of crinkling is reduced.

By means of the inventive arrangement it is possible for the wrap angle α to be reduced with respect to the conventionally occurring wrap angle β, which allows the winding process to be improved. At this point it should be stated that in accordance with the invention—i.e. independently of the form of embodiment of the invention in question—a wrap angle α of 10° or less is particularly advantageous and can also be achieved.

Moreover it is also possible by means of the inventive arrangement for the wrap angle α to be adapted, as is described in what follows.

The above-described entry of air into the region of the contact line 26 depends on, amongst other factors, the feed rate and the surface finish of the film 5, i.e. also on its composition. It then further depends on the composition as to what the effects of the introduced air are, i.e. to what extent an undesirable warpage of the film and the crinkling that is caused by the latter occur.

Accordingly it is advantageous for very sensitive films, at least over a sector of the winding process, to provide a design value or set value for the wrap angle in the region of 0° (i.e. also: to hold the latter constant), although a further stabilisation of the film as a result of a section of the film 5 that is running through the contact roller and lying on the latter is then omitted. With a wrap angle of 0° a minimal resistance ensues against the air that is being squashed backwards.

On the other hand it can be advantageous, depending upon the composition that is present, (for example in the case of adhesive films) to permit certain quantities of air in the gap between the contact roller 19 and the roll 18 and to permit a wrap angle α with a predetermined design value.

Once again this design value or set value can be constant, at least over part of the winding process, and/or it can vary in a predetermined manner as the winding process proceeds. The roll 18 that is created then hardens less and can be easier to unwind.

It ensues that the optimal wrap angle α depends on various factors such as, for example, the composition of the film 5, the feed rate of the film 5, the pressure applied by the contact roller 19 onto the roll 18, etc; these can also include the progression of the winding process. The person skilled in the art can, for example, establish by means of simple tests how the wrap angle is to be adjusted for a given composition in conjunction with other parameters such as the feed rate. In view of the multiplicity of compositions it is not possible to provide a general rule.

In any event it is in accordance with the invention to maintain the design value or set value of the wrap angle α at 90° or less as the winding process proceeds; this enables all films of today's known art to be wound in an optimal manner.

Depending upon the type of film the design value or set value of the wrap angle α is maintained at 45° or less, preferably at 20° or less, particularly preferably at 10° or less, as the winding process proceeds through to the complete roll.

In accordance with the experience of the applicants a range of design values of 10° or less is optimal for many films, and therefore of particular importance.

Needless to say these design values can assume any value in the range in question.

In summary, the inventive method consists in the manufacture of a roll of a material web of flexible material in which the flexible material is guided over a contact roller of a winder, and in the latter is wound on so as to form a roll, wherein the contact roller maintains contact with the roll during the winding process, and wherein the wrap angle of the material web running over the contact roller is continuously maintained as the winding process proceeds at a variable design value that is predetermined for the winding process in question.

Here, as stated above, the design value is preferably maintained at 10° or less.

In an inventive device, means are provided (in the case of the form of embodiment shown in FIG. 2 the further swing arms 31 with their drive 33) for maintaining, as the winding of a roll 18 proceeds, a variable design value for the wrap angle α of the material web running over the contact roller 30, which can be predetermined for the winding process in question.

The means are preferably designed for a design value of the wrap angle α of 90° or less over the whole process of winding a roll through to the complete roll. Furthermore the means are preferably designed for a design value of the wrap angle α of 45° or less, preferably of 20° or less, particularly preferably of 10° or less, over the whole process of winding a roll through to the complete roll.

Here the means are designed in accordance with the invention such that the design value can be freely selected within one of the ranges cited; that is to say, the selection is not subject to any constraint as a result of the actual design of these means.

Here, furthermore, the means preferably have an ancillary roller, over which the material web is guided in operation, wherein the ancillary roller is arranged such that it can be moved with respect to the contact roller during the winding process, such that in operation, depending upon the respective position of the ancillary roller, the material web running off the ancillary roller runs onto the contact roller at another location.

It is furthermore preferable for the movement of the ancillary roller with respect to the contact roller to be continuous, but it can, for example in the case of a simple, cost-effective form of embodiment, also take place in a stepwise manner, if a certain variation of the wrap angle during the winding process may be accepted.

As stated above in the description relating to FIG. 2, a machinery controller is preferably provided, which operationally controls the pivotal drives for the swing arms 20 and the further swing arms 31. Design values for the wrap angle α can then be stored in a memory of the machinery controller; as described above these have been determined as a function of the progress of the winding process, the composition, other parameters, or a combination of these.

FIGS. 4*a* to 4*e* show in a sequence the winding process for a roll 18 from the start of the winding process (FIG. 4*a*) through to the complete roll (FIG. 4*e*). The further swing arms 31, which carry the ancillary roller 30, are schematically represented as a line in the figures in the interests of better clarity.

In the figures it can be seen how, at the start of the winding process, the swing arms 20 are deflected to the right, and with the ongoing progress of the winding process are deflected to the left, as the diameter of the roll 18 increases. Similarly it can be seen that at the start of the winding process the further swing arms 31, schematically represented by a line, have also been pivoted to the right with respect to the swing arms 20, and thus have been moved relative to the contact roller 19, with the consequence that the wrap angle α (FIG. 3) of the film 5 on the contact roller 19 is small. In the course of the winding process the further swing arms 31 are pivoted to the left with respect to the swing arms 20, with the consequence that here the wrap angle α remains essentially small and constant.

From the sequence it can also be deduced that in the case of a conventional ancillary roller 30* (FIG. 3) arranged in a fixed manner in the swing arms 20 the wrap angle β (FIG. 3) at the start of the winding process (FIG. 4*a*) would be unavoidably large, and at the end of the winding process (FIG. 4*e*) would be unavoidably smaller. This difference can easily be as much as 10° or more. In accordance with the invention not only is this difference avoided, but also the wrap angle α can moreover be continuously matched during the whole of the winding process for an optimal winding result.

FIGS. 5*a* and 5*b* show schematically a further form of embodiment of the present invention. What is illustrated is a winding station 14 (FIG. 1) of a winder, with a winding shaft 11 and a contact roller 19, which, however, is not mounted on swing arms, but here instead on a multi-joint suspension 50, which possesses levers 52 mounted on joints 51; the levers for their part carry support arms 54 via joints 53; the contact roller 19 is mounted on the support arms. When the winder is in operation the arrangement illustrated allows the contact roller to move along a horizontal, which in turn simplifies the linear movement drive for the ancillary roller 55, or more particularly its control, since the contact roller 19 runs linearly and no longer along an arc.

The ancillary roller 30 is arranged such that it can be moved horizontally via a trolley 56 on rails 57. Depending upon the position of the ancillary roller 30 with respect to the contact roller 19 there ensues a corresponding wrap angle α of the film 5 on the contact roller.

FIG. 6 shows schematically a further form of embodiment of the present invention. Once again the contact roller 19 is suspended on swing arms 60, indicated schematically by a thick line, wherein the swing arms 60 can be pivoted about a pivot axis 61. The ancillary roller 30 is mounted such that it can be moved along a section 62 of the pivot arms 60. The pivot arms 60 are themselves preferably designed in the form of a double crank, such that the section 60 does not lie along the line 63 connecting the pivot axis 61 and the axis 64 of the contact roller, but rather is inclined at an angle to the latter. If the ancillary roller is moved in accordance with the double arrow 65 as drawn, the location of the contact line 41 alters, and with it the wrap angle α. The person skilled in the art can determine the crank angles and a suitable drive for the movement of the ancillary roller 30 along the section 62, and can operationally connect the drive with an appropriate machinery controller such that in operation a wrap angle α can be maintained that is matched to the roll in question and, if desired, to the progress of the winding process.

In accordance with the invention the ancillary roller can also be moved along swing arms of a straight design, in the case, for example, in which only a small operating range of the wrap angle α is deemed to be necessary.

At this point it should be noted that the above described entry of air not only takes place in the region of the wrap angle α of the film 5 on the contact roller, but in principle also in the roll 18 itself. In the forms of embodiment illustrated in FIGS. 3 to 6 the wrap angle α on the roll 18 is always somewhat larger than 0°. Where appropriate, however, depending upon the conditions in the roll 18, the person skilled in the art can also make provision for the ancillary roller to be positioned during the winding process such that a wrap angle is created on the roll 18 (and no longer on the contact roller 19) so as to generate a controlled entry of air on the roll 18.

The invention claimed is:

1. A method for manufacture of a roll of a material web of flexible material, the method comprising:

guiding a material web over a contact roller of a winder;

winding the material web to form a roll;

wherein the contact roller maintains contact with the roll during a winding process; and wherein, a wrap angle of the material web running over the contact roller is maintained at a predetermined constant set value as the winding process proceeds from the beginning of winding through to completion of the roll.

2. The method in accordance with claim 1, wherein the predetermined constant set value of the wrap angle is maintained at 90° or less as the winding process proceeds through to the complete roll.

3. The method in accordance with claim 2, wherein the predetermined constant set value of the wrap angle is maintained at 45° or less as the winding process proceeds through to the complete roll.

4. The method in accordance with claim 2, wherein the wrap angle is provided on the roll, at least over a sector of the winding process.

5. The method in accordance with claim 1, wherein the predetermined constant set value of the wrap angle lies in a vicinity of zero as the winding process proceeds, at least in part.

6. A winder for execution of the method in accordance with claim 1, the winder comprising:

a contact roller and an entity for mounting of the roll to be wound; and wherein, in operation, the contact roller maintains contact with the roll during the winding process.

7. The winder in accordance with claim 6, comprising:

an ancillary roller, over which the material web is guided when in operation; and the ancillary roller during the winding process is arranged such that it can be moved relative to the contact roller, such that in operation, depending upon a respective position of the ancillary roller, the material web running off the ancillary roller runs onto the contact roller at a location of another contact line.

8. The winder in accordance with claim 7, wherein the ancillary roller is arranged with respect to the contact roller such that it can be moved relative to the latter in a continuous manner.

9. The winder in accordance with claim 8, wherein:

means for maintaining the predetermined constant set value of the wrap angle comprise a gear train, via which the swing arms and the further swing arms are connected with one another; and in the event of a pivotal movement of the swing arms the gear train generates a pivotal movement of the further swing arms.

10. The winder in accordance with claim 9, wherein the gear train generates a pivotal movement of the swing arms with respect to the further swing arms in the ratio 1:1.5.

11. The winder in accordance with claim 7, wherein the ancillary roller is mounted on further swing arms, wherein the swing arms are arranged such that they can be moved relative to the contact roller.

12. The winder in accordance with claim 7, wherein the contact roller is arranged on swing arms, which with the further swing arms of the ancillary roller have a common pivot axis.

13. The winder in accordance with claim 7, wherein the contact roller is arranged on swing arms, and the ancillary roller is mounted on the latter such that it can move longitudinally.

14. The winder in accordance with claim 7, wherein the ancillary roller is mounted on rails.

15. The winder in accordance with claim 7, wherein:

the contact roller and the ancillary roller are arranged on swing arms; and the ancillary roller is mounted such that it can be moved in a predetermined manner along a section of the swing arms.

16. The winder in accordance with claim 6, wherein means are designed, at least during a part of the winding process, so as to maintain the predetermined constant set value of the wrap angle of the material web on the roll located in the winding process.

17. The winder in accordance with claim 6, wherein the winder with a machinery controller is connected with means for maintaining the constant set value of the wrap angle, and is designed to control the latter during the process of winding the roll.

18. The winder in accordance with claim 17, wherein the means are designed for maintaining the predetermined constant set value of the wrap angle at 90° or less over the whole process of winding the roll through to the complete roll.

19. The winder in accordance with claim 6, wherein means are designed for maintaining the predetermined constant set value of the wrap angle at 90° or less over the whole process of winding the roll through to the complete roll.

20. The winder in accordance with claim 19, wherein the contact roller is designed for maintaining the predetermined constant set value of the wrap angle at 45° or less over the whole process of winding the roll through to the complete roll.

* * * * *